US006233416B1

(12) United States Patent
Kinosita et al.

(10) Patent No.: US 6,233,416 B1
(45) Date of Patent: May 15, 2001

(54) ELECTROPHOTOGRAPHY WITH AC ERASING OF LATENT IMAGE

(75) Inventors: Koichi Kinosita, Shizuoka; Takaaki Konuma, Kanagawa; Masanori Abe, Yokosuka; Masahiro Sato, Chiba, all of (JP)

(73) Assignee: Kimoto Co., Ltd. (JP)

( * ) Notice: Subject to any disclaimer, the term of this patent is extended or adjusted under 35 U.S.C. 154(b) by 0 days.

(21) Appl. No.: 09/381,854

(22) PCT Filed: Mar. 26, 1998

(86) PCT No.: PCT/JP98/01345

§ 371 Date: Dec. 27, 1999

§ 102(e) Date: Dec. 27, 1999

(87) PCT Pub. No.: WO98/44393

PCT Pub. Date: Oct. 8, 1998

(30) Foreign Application Priority Data

Mar. 31, 1997 (JP) ..... 9-080463

(51) Int. Cl.[7] ..... G03G 15/056; G03G 21/06; G03G 15/02

(52) U.S. Cl. ..... 399/128; 399/153; 399/175

(58) Field of Search ..... 399/128, 153, 399/175

(56) References Cited

U.S. PATENT DOCUMENTS

| | | | | |
|---|---|---|---|---|
| 4,136,942 | * | 1/1979 | Nakahata et al. | 399/153 |
| 4,413,897 | * | 11/1983 | Kohyama | 399/128 |
| 4,757,345 | * | 7/1988 | Ohashi et al. | 399/128 |
| 4,827,306 | * | 5/1989 | Tsujimoto et al. | 399/128 |
| 5,512,983 | * | 4/1996 | Fukushima et al. | 399/153 |
| 5,652,649 | * | 7/1997 | Ikegawa et al. | 399/175 |

* cited by examiner

*Primary Examiner*—Fred L Braun
(74) *Attorney, Agent, or Firm*—Lorusso & Loud

(57) ABSTRACT

An image-forming apparatus includes a photosensitive member having a gamma for latent image of 3 or more, electrification facilities, light exposure facilities, image development facilities, image transfer facilities, cleaning facilities, and a charge erasing light source which applies an alternating current electric field at a frequency of 50 Hz to 1 kHz to a portion of the photosensitive member which is excited through light exposure by the charge erasing light source. Images with high quality and high resolution can be stably formed without residual images, even when continuous image formation is performed by utilizing a high gamma electrophotographic photosensitive member.

10 Claims, 6 Drawing Sheets

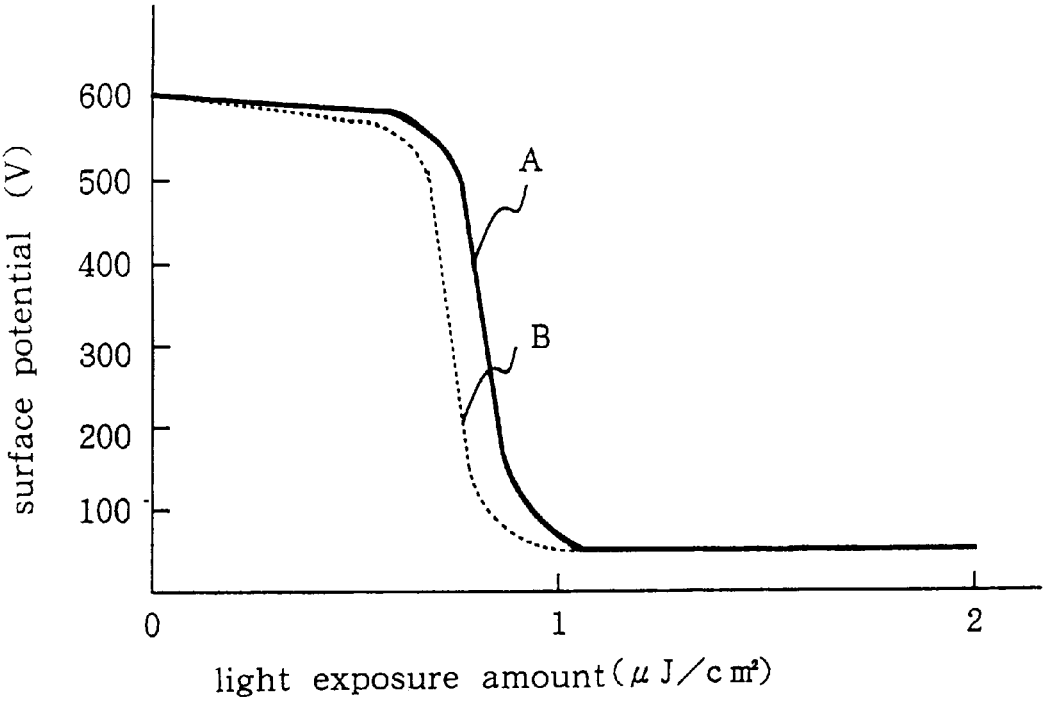
FIG. 8
FIG. 9
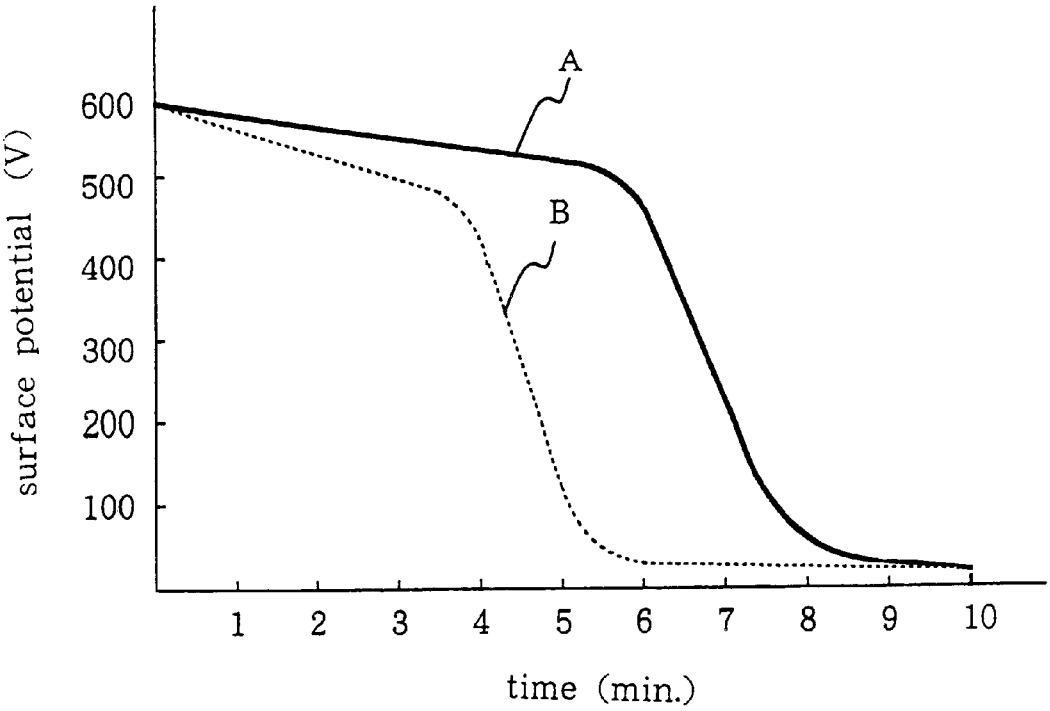
FIG. 9

ELECTROPHOTOGRAPHY WITH AC ERASING OF LATENT IMAGE

BACKGROUND OF THE INVENTION

1. Field of the Invention

The present invention relates to an electrophotographic image-forming apparatus and an electrophotographic image-forming method utilizing an electrophotographic photosensitive member of high gamma, in particular, an electrophotographic photosensitive member for digital photo-input. More precisely, the present invention relates to an electrophotographic image-forming apparatus and an electrophotographic image-forming method utilizing a novel charge erasing method.

2. Background Art

As shown in FIG. 5, conventional electrophotographic image-forming apparatuses have, for example, a structure comprising, around a rotatably maintained cylindrical photosensitive member 1, a main electrifier 2, light exposure means 3, image development means 4, image transfer means 5, cleaning means 6, and charge erasing (eliminating) light source 7 in this order, and charge erasing of the photosensitive member is attained by light-exposing the surface of the photosensitive member 1 by means of the charge erasing light source 7.

On the other hand, photosensitive members of high gamma have been developed in recent years in order to form static latent images with high resolution in electrophotographic image formation, in particular, by digital photo-input. For example, Japanese Patent Publication (Kokoku) No. 5-19140 discloses an electrophotographic photosensitive member for digital photo-input having a gamma for latent image of 6 or more, which comprises a photosensitive layer consisting of intrinsic semiconductor fine powder contained in a binder having a high volume resistivity. Japanese Patent Unexamined Publication (Kokai) No. 8-286396 also discloses a photosensitive member having a gamma value of 2 to less than 6.

However, because such photosensitive layers of high gamma utilize a highly resistive binder, charge transfer therein is strongly prevented, and after electrification, a part of charge flowing in the photosensitive members by the light exposure remains throughout the whole photosensitive layer. Therefore, it is difficult to completely erase the charge after the image formation only by the light exposure as in the conventional electrophotographic image-forming apparatuses. As a result, the high-gamma photosensitive members suffer a problem of so-called hysteresis, i.e., electrification potential may be different among light-exposed areas and unexposed areas in a former image formation process, and thus images of high resolution cannot be stably formed.

Moreover, there is also the problem of sensitivity shift, i.e., shift of the sensitivity curve of the photosensitive member in the higher sensitivity direction due to the residual charge in the photosensitive member caused by repetition of image formation.

A larger light exposure amount for charge erasing may excite a deeper portion of the photosensitive member by its photocurrent, thereby providing uniform charge distribution. However, the light energy may accelerate yield of the binder of the photosensitive member, and hence dark decay may become faster. This may make sequential image-forming operations impossible.

Furthermore, reversal development is usually used in printers, in which a transfer electrifier is applied with a voltage of opposite polarity to that applied to the main electrifier, and may invite another problem. That is, such voltage of reverse polarity provides a field of opposite polarity to that of the main electrification inside the photosensitive member, and this may cause sensitivity variation due to higher internal field during the main electrification. Thus, images cannot be stably formed.

Therefore, various techniques have been proposed in order to solve such problems as mentioned above. For example, Japanese Patent Unexamined Publication (Kokai) No. 4-337762 proposes a method comprising controlling light exposure amounts for image formation and charge erasing to be in a particular relationship in order to solve the aforementioned problem of hysteresis. This method may achieve the desired effect for a photosensitive member of a gamma for latent image of less than 3. However, when the gamma for latent image is 3 or higher, completely stable operation cannot be performed even with this technique, because of sensitivity variation due to ununiform electrification after repeated image formation and the like.

Therefore, the object of the present invention is to provide an image-forming apparatus and an image-forming method that can solve the aforementioned problems, specifically an apparatus and a method enabling effective uniform charge erasing (eliminating), hence not causing the so-called hysteresis or sensitivity shift even in continuous image formation, and capable of stably forming images of high quality and high resolution without residual images in electrophotographic image formation utilizing a high-gamma photosensitive member.

SUMMARY OF THE INVENTION

The image-forming apparatus of the present invention comprises a photosensitive member having a gamma for latent image of 3 or more, electrification means, light exposure means, image development means, image transfer means, cleaning means, and a charge erasing (eliminating) light source, wherein the image-forming apparatus further comprises electric field applying means for applying an alternating current electric field at a frequency of 50 Hz to 1 kHz to a portion of the photosensitive member which is excited through light exposure by the charge erasing light source.

One embodiment of the image-forming apparatus of the present invention is an image-forming apparatus comprising, around a rotatably maintained cylindrical photosensitive member 1 having a gamma for latent image of 3 or more, a main electrifier 2, a light exposure means 3, an image development means 4, an image transfer means 5, and a cleaning means 6 in this order, wherein the image-forming apparatus comprises a charge erasing light source 7 for light exposure of photosensitive member surface and the electric field applying means 9 for applying an alternating current electric field at a frequency of 50 Hz to 1 kHz to a portion of the photosensitive member which is excited through light exposure by the charge erasing light source between the cleaning means 6 and the main electrifier 2 (FIG. 1).

In the aforementioned image-forming apparatus of the present invention, an alternating current electrifier, which is the electric field applying means 9, may be provided between the charge erasing light source 7 and the photosensitive member surface which is light-exposed by the charge erasing light source, and applies an alternating current electric field at a frequency of 50 Hz to 1 kHz to a portion of the photosensitive member excited through light exposure by the charge erasing light source (FIG. 1).

Alternatively, in the aforementioned image-forming apparatus of the present invention, an alternating current electrifier, which is the electric field applying means 9, may be provided immediately after the charge erasing light source 7 with respect to the photosensitive member surface, and applies an alternating current electric field at a frequency of 50 Hz to 1 kHz to a portion of the photosensitive member which is excited through light exposure by the charge erasing light source (FIG. 2).

In the aforementioned image-forming apparatus of the present invention, the electric field applying means may be a contact electrifier 9*a* generating an alternating current electric field at a frequency of 50 Hz to 1 kHz, which is provided immediately after the charge erasing light source 7*a* with respect to the photosensitive member surface so that a portion of the photosensitive member which is excited through light exposure by the charge erasing light source 7*a* is contacted by the contact electrifier 9*a,* and applied with an alternating current electric field at a frequency of 50 Hz to 1 kHz (FIG. 3).

In a preferred embodiment of the image-forming apparatus of the present invention, the charge erasing light source 7 is provided with a filter which cuts light of a wavelength shorter than sensitization wavelength for the photosensitive member by 150 nm or more (FIG. 4).

In another embodiment of the image-forming apparatus of the present invention, a direct current electric field is superimposed on the alternating current field generated by the alternating current electrifier, which is the electric field applying means, by using a direct current bias voltage from a power source 11 ranging from −1 kV to +1 kV, so that both of the fields are applied to the surface portion of the photosensitive member excited through the light exposure (FIG. 4).

In another its aspects, the present invention also provides a method for electrophotographic image formation comprising electrification of a photosensitive member having a gamma for latent image of 3 or more, light exposure of the member, image development, image transfer, and charge erasing of the photosensitive member, wherein the charge erasing of the photosensitive member is performed by light-exposing a surface portion of the photosensitive member with a charge erasing light source, and applying an alternating current electric field at a frequency of 50 Hz to 1 kHz to the portion of the photosensitive member while the portion is excited by the light exposure.

BRIEF EXPLANATION OF THE DRAWINGS

FIG. 8 is a graph comparing sensitivity characteristic variations of a photosensitive member after image formation according to the method of the present invention and a conventional method.

FIG. 9 is a graph comparing of dark decay characteristic variations of a photosensitive member after image formation according to the method of the present invention and a conventional method.

DETAILED DESCRIPTION OF THE PREFERRED EMBODIMENTS

Figure 1:
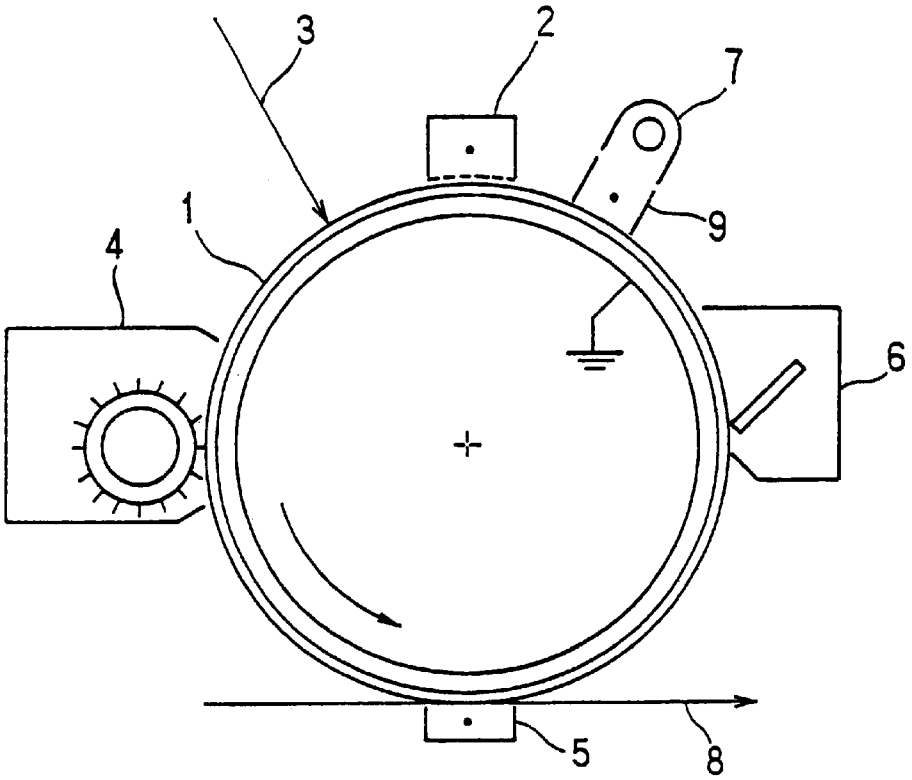
FIG. 1 is a schematic view of an exemplary image-forming apparatus of the present invention.

The image-forming apparatus and the image-forming method of the present invention are characterized by, in such electrophotographic image-forming apparatus and method as mentioned above, applying an alternating current electric field to a photosensitive member in a state excited through light exposure by charge erasing light for charge erasing of the photosensitive member before the main electrification. The charge erasing light generates movable charge in the photosensitive member (the term "photosensitive member excited through light exposure" herein used means the member that is in such a state where freely movable charge is generated as mentioned above). The generated charge is alternately moved by the alternating current electric field in the photosensitive member, and thus localized residual charge is eliminated or uniformized to a certain level. This erases the remnant of the previous image formation, and electrification amount of the main electrification is maintained constant. Thus, the aforementioned problems of hysteresis and sensitivity shift can be overcome, and images of high resolution can be stably formed without residual images.

High-gamma photosensitive members such as those having a gamma for latent image of 6 or more disclosed in, for example, Japanese Patent Publication (Kokoku) No. 5-19140 are composed of a material whose charge does not move when it is at a low level but is moved by the avalanche effect at a certain charge amount, that is, the material undergoes explosive charge movement when the charge reaches a certain level. This means that high gamma photosensitive members are more likely to be influenced by variation and unevenness of the residual charge in the members compared with low gamma photosensitive members where charge moves relatively slowly, and the high gamma photosensitive members are likely to suffer sensitivity shift due to the residual charge in the members, for example. Therefore, unless charge is sufficiently erased or uniformized, the sensitivity characteristic of the photosensitive members may be changed, and stable image formation can no longer be obtained.

In fact, if image formation is repeated with the charge erasing only by light exposure in such an electrophotographic image-forming apparatus as mentioned above, the sensitivity of the photosensitive member gradually becomes higher, and thus the image formation gradually becomes more unstable, even though it may be stable at an earlier stage.

According to the present invention, in contrast, the internal charge state of the photosensitive member is maintained constant thanks to the aforementioned mechanism, and the sensitivity is maintained substantially constant. Likewise, dark decay and other sensitivity characteristics are also maintained constant. Furthermore, the problem of reverse polarity charge distribution observed in cases that the transfer electrifier is applied with a voltage of polarity reverse to that applied to the main electrifier is also eliminated. In addition, stability of the image formation is not influenced by characteristics of the image-receiving paper sheets, and absence or presence thereof.

Because of the advantages provided by the aforementioned features of the present invention, the light amount for charge erasing may be selected from a broader range compared with the cases where only the charge erasing light is used. When only the charge erasing light is used, charge erasing light in an amount of 5 times or more of that for image light exposure may cause residual images, and charge erasing light in an amount of 10 times or more of the same may make dark decay faster. However, according to the present invention, residual images are not generated even with a charge erasing light amount comparable to that for the image light exposure, and the dark decay is maintained stable even with a charge erasing light in an amount of 50 times or more of that for image light exposure.

The image-forming apparatus and the image-forming method of the present invention will be further explained more in detail hereafter with reference to the appended drawings.

The image-forming apparatus of the present invention is an image-forming apparatus comprising a photosensitive member having a gamma for latent image of 3 or more, electrification means, light exposure means, image development means, image transfer means, cleaning means, and a charge erasing light source, characterized by further comprising electric field applying means for applying an alternating current electric field at a frequency of 50 Hz to 1 kHz to a portion of the photosensitive member which is excited through light exposure by the charge erasing light source.

As mentioned above, the image-forming apparatus of the present invention is characterized by, before the main electrification, applying an alternating current electric field to the photosensitive member excited through the light exposure by the charge erasing light for charge erasing of the photosensitive member. Therefore, the temporal relationship between the light exposure of the photosensitive member by the charge erasing light and application of the alternating current electric field, and the spatial relationship between the means for charge erasing of the photosensitive member by charge erasing light and the means for applying an alternating current electric field with respect to the photosensitive member are not particularly limited so long as the alternating current electric field can be applied to the photosensitive member excited by the light exposure. More specifically, the starting and finishing time points of the light exposure by charge erasing light and application of the alternating current electric field, the order which means for light exposure with charge erasing light or means for applying the alternating current electric field is positioned forward with respect to the moving photosensitive member and the like are not particularly limited so long as the alternating current electric field can be applied to the photosensitive member excited by the light exposure.

As shown in FIG. 1, the image-forming apparatus of the present invention may have, for example, a structure comprising, around a rotatably maintained cylindrical photosensitive member 1 having a gamma for latent images of 3 or more, a main electrifier 2, a light exposure means 3, an image development means 4, an image transfer means 5, and a cleaning means 6 in this order, and further comprises a charge erasing light source 7 for light exposure of photosensitive member surface and an electric field applying means 9 for applying an alternating current electric field at a frequency of 50 Hz to 1 kHz to a portion of the photosensitive member which is excited through light exposure by the charge erasing light source between the cleaning means 6 and the main electrifier 2.

The image-forming apparatus shown in FIG. 1 is provided with the alternating current electrifier 9, which is the electric field applying means, between the charge erasing light source 7 and the photosensitive member surface to be light-exposed by it, thereby applying an alternating current electric field at a frequency of 50 Hz to 1 kHz to a portion of the photosensitive member which is excited through light exposure by the charge erasing light source.

The aforementioned structure of electrophotographic image-forming apparatus comprising, around a rotatably maintained cylindrical photosensitive member 1, a main electrifier 2, a light exposure means 3, an image development means 4, an image transfer means 5, and a cleaning means 6 in this order is known, and each means or component may be a conventional one.

However, the image-forming apparatus of the present invention is not limited to such a structure as mentioned above, and includes electrophotographic image-forming apparatuses utilizing a photosensitive member in the form of, for example, continuous belt or the like.

The photosensitive member having a high gamma for latent image used for the present invention is also known. The photosensitive member disclosed in Japanese Patent Publication (Kokoku) No. 5-19140, for example, can be used as the high-gamma photosensitive member.

The photosensitive member disclosed in Japanese Patent Publication (Kokoku) No. 5-19140 comprises a photosensitive layer having a thickness of 5–30 $\mu$m, which is formed from intrinsic semiconductor fine powder having a mean particle diameter of 0.01–0.5 $\mu$m contained in a binder having a volume specific resistivity of $10^{13}$ Ω/cm or more. Examples of the intrinsic semiconductor fine powder include, for example, copper phthalocyanine microcrystals, non-metal phthalocyanine microcrystals, tytanyl phthalocyanine microcrystals, sensitized zinc oxide microcrystals, sensitized titanium oxide microcrystals, selenium fine powder and the like. As the binder, there can be mentioned, for example, polyester resin, melamine resin, polyurethane resin, styrene/butadiene resin, polyvinyl butyral resin, silicone resin, acrylic resin, silicone-modified acrylic resin, mixtures thereof and the like.

Gamma is a concept originally used for photosensitive materials for silver salt photographic materials, and represented by tangent of gradient degree of a straight portion in a photographic characteristic curve, which is obtained by plotting image blackening degree against light exposure amount. This parameter is also used for representing characteristics of an electrophotographic photosensitive member as a parameter representing one-on-one relationship between latent image intensity and density of the corresponding developed image. In electrophotography, gamma is represented by tangent of gradient degree of a straight portion in a characteristic curve which is obtained by plotting surface potential (V) against light exposure amount (log [$\mu$J/cm$^2$]). Because the gamma in the electrophotography is obtained from the relationship between latent image intensity and density of the corresponding developed image, it may be called "gamma for latent image", and this term is used regarding the present invention.

The present invention contemplates use of a high-gamma electrophotographic photosensitive member, in particular, an electrophotographic photosensitive member having a gamma for latent image of 3 or more. More preferably, a photosensitive member having a gamma for latent image of 6 or more is used.

The electric field applying means for generating an alternating current electric field and applying it to a portion of the photosensitive member which is excited through light exposure by the charge erasing light source may be selected from any means known to be capable of achieving such an object. For example, an alternating current electrifier can preferably be used. Such an alternating current electrifier may be a conventionally known one, for example, a corona electrifier or a contact electrifier as explained hereinafter.

As mentioned above, the charge erasing light generates movable charge in a light exposed portion of the photosensitive member, and the generated charge is alternately moved by the alternating current electric field applied to the portion. In the case of the photosensitive member having a gamma for latent image of 3 or more as used in the present invention, the charge may be effectively erased or uniformized by using an alternating current electric field at a frequency of 50 Hz to 1 kHz. The specific frequency may be determined depending on the operation speed of the image-forming apparatus, desired charge erasing degree and the like. A field at a frequency of less than 50 Hz is not practical in view of the operation speed of actual image-forming apparatuses, whereas the desired charge moving effect is difficult to obtain by a field at a frequency exceeding 1 kHz.

When a corona electrifier is used as the electric field applying means, for example, an alternating current electric field is generated by applying a voltage of generally about 3 to 10 kV, preferably about 3.5 to 6 kV, to the electrifier, and the desired charge moving effect is obtained by providing a field intensity of generally $1\times10^4$ V/cm or more, preferably $1\times10^5$ V/cm or more.

In the image-forming apparatus of FIG. 1, the alternating current electrifier 9, which is the electric field applying means, is placed before the charge erasing light source 7 on the photosensitive member surface side, and it generates an alternating current electric field at a frequency of 50 Hz to 1 kHz over the portion of the photosensitive member light-exposed by the charge erasing light source 7, so that the alternating current electric field is applied to the portion of the photosensitive member excited by the light exposure.

In the aforementioned image-forming apparatus of FIG. 1, the image formation is carried out in the same manner as in conventional electrophotographic image formation, except that the alternating current electric field at a frequency of 50 Hz to 1 kHz is applied to the portion of the photosensitive member light-exposed by the charge erasing light source 7 so that the alternate electric field is superimposed on the light exposure. That is, the photosensitive member 1 is electrified by the main electrifier 2, and light-exposed imagewise by the light exposure means 3, the formed latent image is developed by the image development means 4 with toner or the like, and the developed image is transferred to a recording material 8 such as paper sheet by the image transfer means 5. After the transfer of the developed image, the surface of the photosensitive member is scraped with the cleaning means 6 having, for example, a blade-like shape to remove toner and the like not transferred, and the charge is erased through the light exposure by the charge erasing light source. During the light exposure for charge erasing, the alternating current electric field generated by the alternating current electrifier is simultaneously applied for charge erasing to uniformize the charge according to the present invention.

Figure 2:
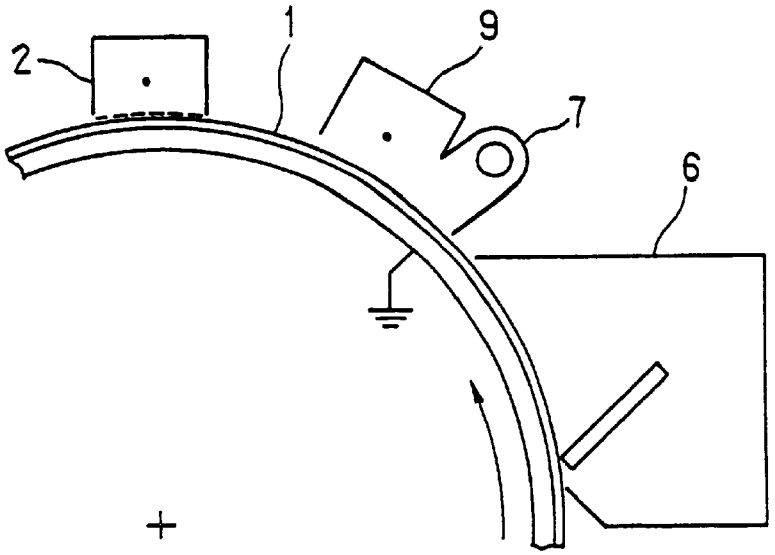
FIG. 2 is a schematic partial view of another exemplary image-forming apparatus of the present invention.

In such an embodiment of the image-forming apparatus of the present invention as mentioned above, the alternating current electrifier 9, which is the electric field applying means, may also be provided immediately after the charge erasing light source 7 with respect to the photosensitive member surface, as shown in FIG. 2, to generate an alternating current electric field at a frequency of 50 Hz to 1 kHz over a portion of the photosensitive member excited through the light exposure by the charge erasing light source.

Figure 3:
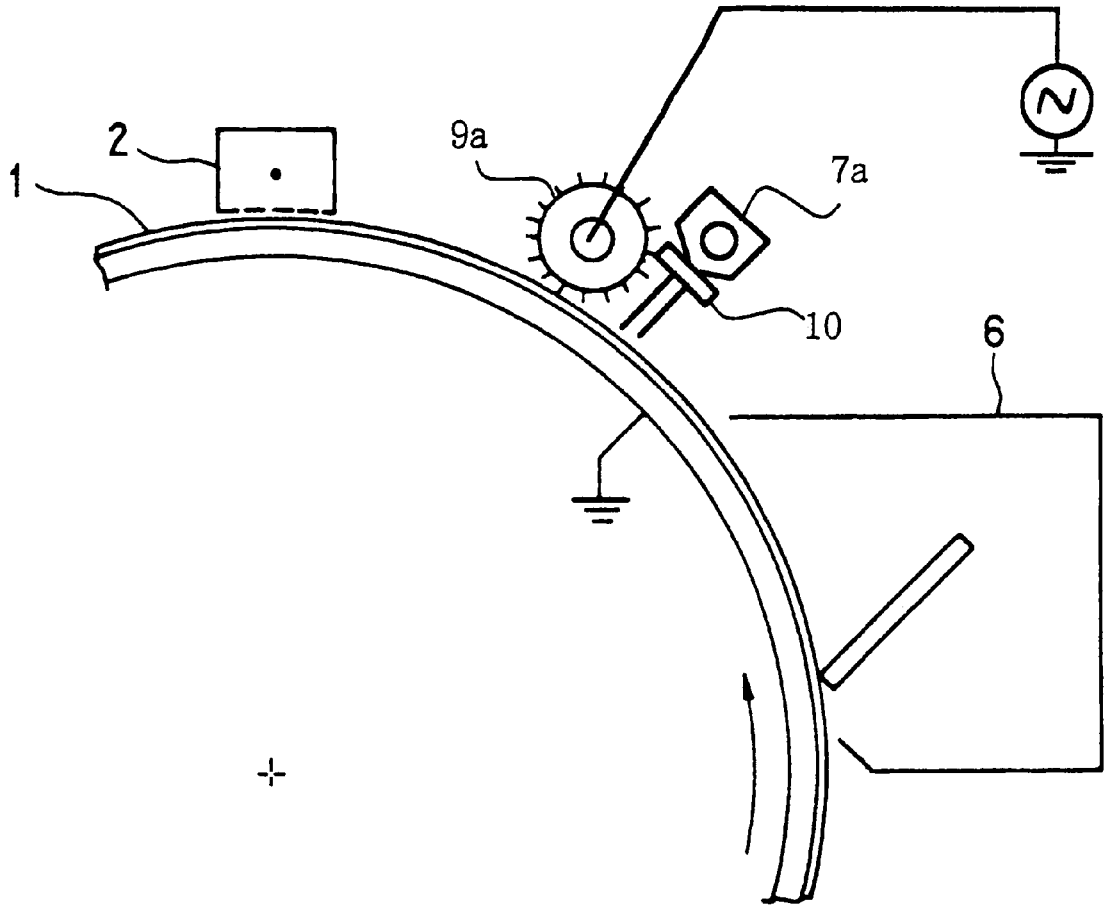
FIG. 3 is a schematic partial view of a further exemplary image-forming apparatus of the present invention.

Furthermore, in such an embodiment of the image-forming apparatus of the present invention as mentioned above, the alternating current electrifier, which is the electric field applying means, may be a contact electrifier. When a contact electrifier is used, a contact electrifier 9*a* generating an alternating current electric field of 50 Hz to 1 kHz can be provided immediately after the charge erasing light source 7*a* in contact with the photosensitive member 1 as shown in FIG. 3, and the photosensitive member surface immediately before the contact with the contact electrifier 9*a* can be light-exposed by the charge erasing light source 7*a,* so that an alternating current electric field of 50 Hz to 1 kHz is applied to a portion of the photosensitive member excited by the light exposure.

The alternating current electrifier of contact type may also be a conventionally known one, and those of rubber roller type, brush type and the like may be used. In FIG. 3, a brush type alternating current electrifier is schematically indicated.

Figure 4:
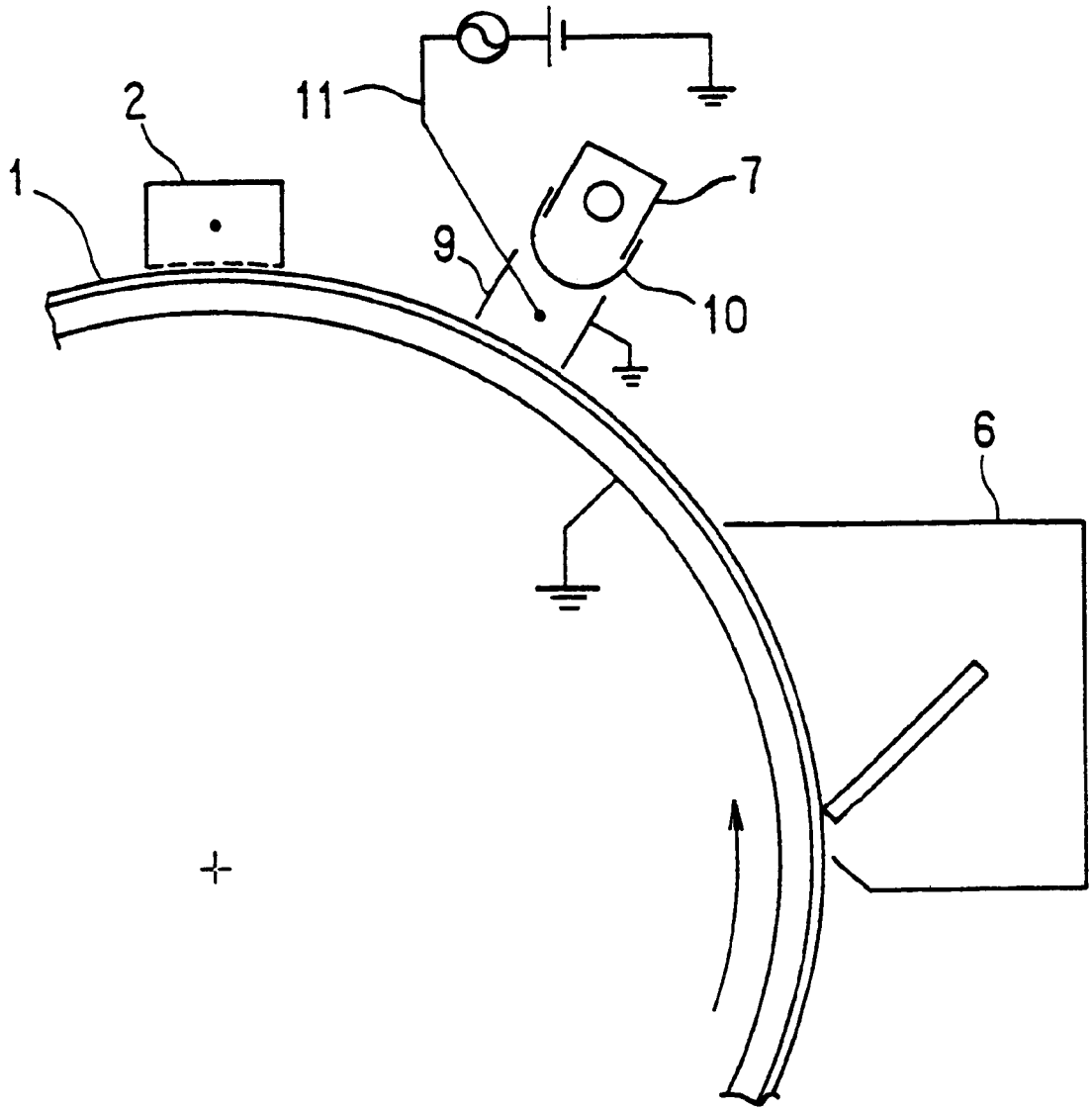
FIG. 4 is a schematic partial view of a still further exemplary image-forming apparatus of the present invention.
Figure 5:
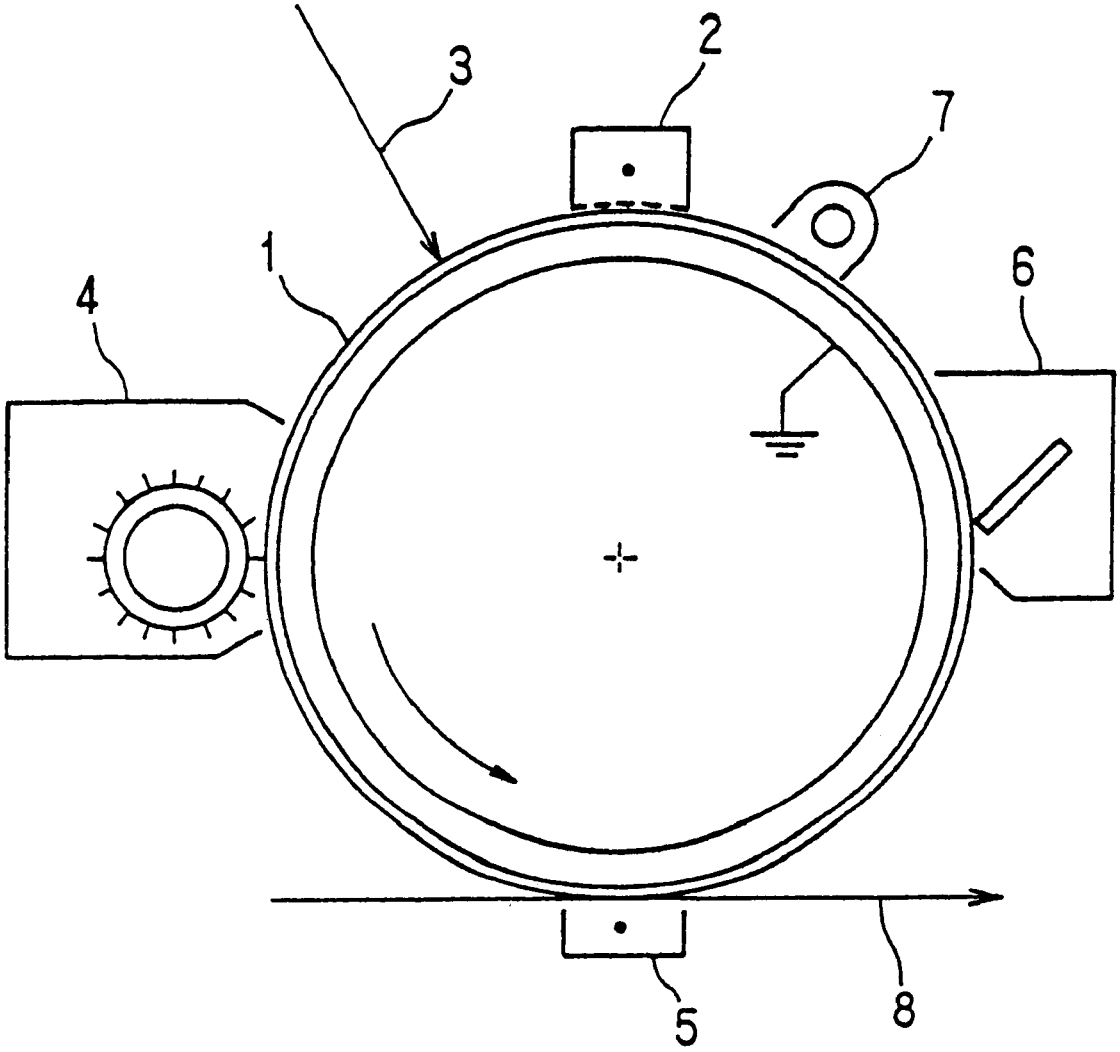
FIG. 5 PRIOR ART
FIG. 5 is a schematic view of a conventional image-forming apparatus.

As for the charge erasing light source, light of a wavelength somewhat shorter than the sensitization wavelength used for the image light exposure is unlikely to show a charge erasing effect with respect to the inside of the photosensitive member, and adversely affects the excited state of the photosensitive member surface. Therefore, such light is preferably cut with a filter or the like. More specifically, the problem concerning shorter wavelength light may be eliminated by cutting light having a wavelength shorter by about 150 nm than the sensitization wavelength used for the image light exposure of the photosensitive member. Therefore, the charge erasing light source 7 of the image-forming apparatus of the present invention is preferably provided with a filter 10 which cuts light of a wavelength shorter by 150 nm or more than the sensitization wavelength for the photosensitive member used as the light exposure means, as shown in FIGS. 3 and 4. For example, when a semiconductor laser with a wavelength of 780 nm is used as the light source for image light exposure, a filter that cuts light with a wavelength of about 630 nm or less is used.

Moreover, depending on the characteristics of the photosensitive member, a direct current electric field may be superimposed on the aforementioned alternating current electric field in order to adjust the intensity of the internal electric field of the photosensitive member. When an alternating current electrifier is used as the electric field applying means, a direct current electric field can be superimposed on the alternating current electric field by applying a direct current bias voltage to the alternating current electrifier from a power source 11 comprising a direct current bias power source in addition to an alternating current high voltage power source, as shown in FIG. 4.

For example, when the photosensitive member has a structure of high charge-transfer prevention power because of high insulation property of the binder used for the photosensitive member or the like, the charge transfer by the alternating current electric field can be enhanced by superimposing a direct current electric field. A negative direct current bias voltage can be applied to the alternating current electrifier when the charge is positive, and a positive direct current bias voltage can be applied when the charge is negative. On the other hand, when the charge-transfer prevention power is low because of use of a binder having relatively low insulation property or the like, the charge transfer by the alternating current electric field can be reduced by superimposing a direct current electric field on the alternating current electric field. In such a case, a positive direct current bias voltage can be applied to the alternating current electrifier when the charge is positive, and a negative direct current bias voltage can be applied when the charge is negative.

The direct current bias voltage for adjusting the electric field intensity may be generally about −1 kV to about +1 kV, and it may be suitably determined according to the desired electric field adjusting effect.

EXAMPLES

The present invention will now be further explained with reference to the examples, but the scope of the present invention is not limited by these.

Example 1

One part by weight of X-type non-metal phthalocyanine microcrystals were dispersed in three parts by weight of a mixed binder composed of polyester resin and melamine resin by mixing them, and applied to an aluminum cylinder having an undercoat layer of casein so that the coated layer had a thickness of 15 $\mu$m. Then, silicone modified acrylic resin (Acrydic 9530, produced by Dainippon Ink & Chemicals, Inc.) was applied on the coated layer in a thickness of 2 $\mu$m as a protective overcoat to obtain a photosensitive member having a gamma for latent image of 10. This photosensitive member was used in an image-forming apparatus having the structure shown in FIG. 4, and image formation was conducted using a semiconductor laser having a wavelength of 780 nm at 1200 DPI. Sensitivity characteristic of the photosensitive member and image stability were determined for comparison of a case utilizing only charge erasing light as in a conventional method and a case where an alternating current electric field of 50 Hz was applied to a portion of the photosensitive member excited by the charge erasing light exposure according to the present invention.

Appropriate light exposure amount for charge erasing and voltage applied for generating the alternating current electric field were empirically determined by performing image formation as values not causing hysteresis (the phenomenon where an image is influenced by previous image formation). As a result, the light exposure amount for charge erasing was decided to be 200 $\mu$J/cm$^2$ for conventional operation utilizing only the charge erasing light, and 30 $\mu$J/cm$^2$ of the light exposure amount for charge erasing, 3.5 kV of the voltage applied to an alternating current corona electrifier, and a direct current bias voltage of +150 V were used for the image formation according to the present invention.

A filter cutting light of a wavelength of 600 nm or less (Popil Type Red, produced by Kimoto Co., Ltd.) was used in both cases, i.e., the case utilizing only the charge erasing light exposure and the case additionally utilizing an alternating current electric field. The corona electrifier used for transferring the developed toner images to image receiving materials was applied with a voltage of −6.3 kV.

Figure 6:
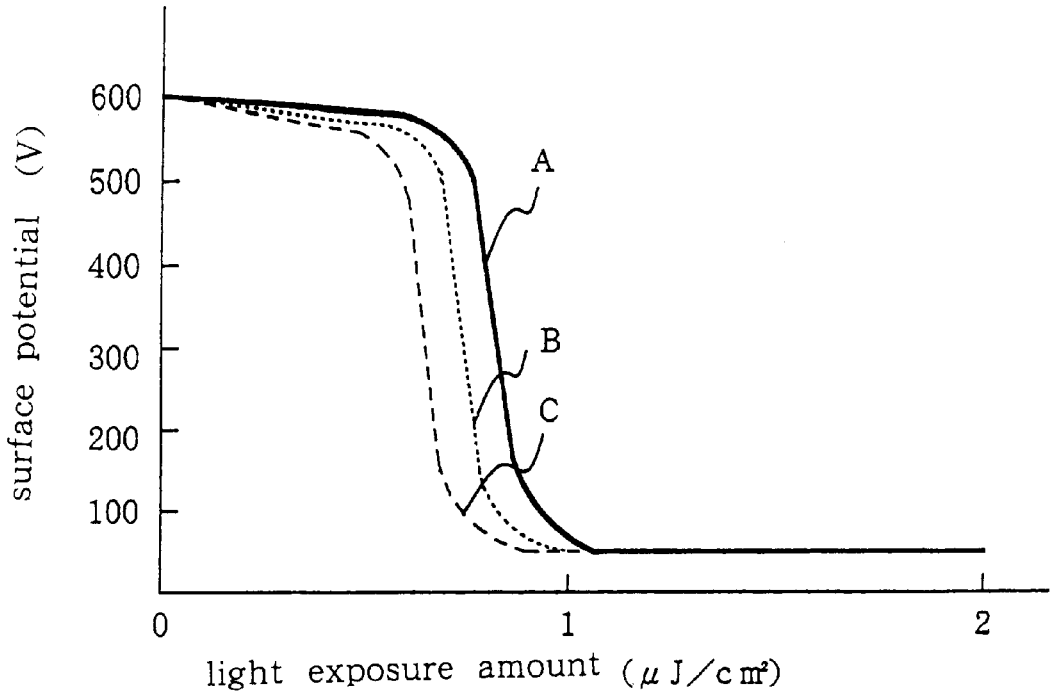
FIG. 6 is a graph comparing sensitivity characteristic variations of a photosensitive member after image formation according to the method of the present invention and a conventional method.

Characteristics of the photosensitive member were determined by measuring surface potential by means of a surface potentiometer provided at the location of the image development means to detect the repetition of dark parts and light parts, while the light exposure amount by the laser ray was varied. The results are shown in FIG. 6. In FIG. 6, the initial characteristic is represented by the curve A, the characteristic after 10,000 times of image formation according to the present invention is represented by the curve B, and the characteristic after 10,000 times of image formation according to the conventional method is represented by the curve C.

As seen from the results shown in FIG. 6, the sensitivity variation from the initial characteristic (A) is clearly smaller and image formation was more stable in the case according to the present invention (B) compared with the case according to the conventional method (C).

Figure 7:
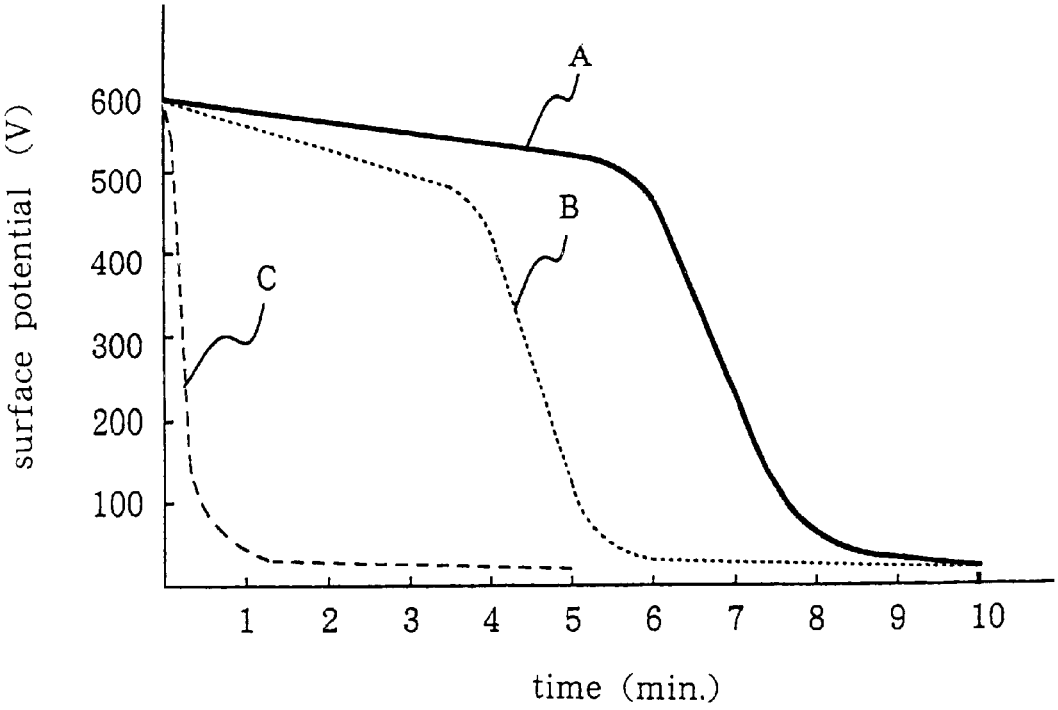
FIG. 7 is a graph comparing dark decay characteristic variations of a photosensitive member after image formation according to the method of the present invention and a conventional method.

Further, dark decay of the photosensitive member was measured by a surface potentiometer for the photosensitive member after 10,000 times of image formation according to the method of the present invention, and the photosensitive member after 10,000 times of image formation according to the conventional method. The results are shown in FIG.7. In FIG. 7, the initial characteristic of dark decay is represented by the curve A, the dark decay of the photosensitive member after 10,000 times of image formation according to the present invention is represented by the curve B, and the dark decay of the photosensitive member after 10,000 times of image formation according to the conventional method is represented by the curve C.

As shown in FIG. 7, the surface potential decay was small even after 3 to 5 minutes in the photosensitive member after 10,000 times of image formation according to the present invention (B), whereas it fell within about 30 seconds in the photosensitive member after 10,000 times of image formation according to the conventional method (C). This suggests that the image-forming apparatus of the present invention can cope with a slower electric signal processing speed to be employed to obtain higher resolution.

Image formation was further repeated 50,000 times according to the method of the present invention, and sensitivity characteristic and dark decay of the photosensitive member were measured. As a result, while shift of about 0.2 $\mu$J/cm$^2$ was observed for the sensitivity characteristic, image quality was not substantially affected because of the high gamma for latent image of the photosensitive member. The dark decay gradually became faster, and was around 2 seconds after 50,000 times of image formation, but it did not change but stayed constant thereafter.

On the other hand, when image formation was further repeated according to the conventional method, the dark decay became too fast to perform image formation before 50,000 times of image formation were performed.

The above results indicate that the method of the present invention is effective for photosensitive members of high gamma values.

Example 2

The same photosensitive member as used in Example 1 was used in an image-forming apparatus provided with a contact electrifier and light exposure means for charge erasing as shown in FIG. 3, and image formation was performed using a semiconductor laser having a wavelength of 780 nm at 1200 DPI to examine the sensitivity characteristic of the photosensitive member and image stability.

The contact electrifier was provided with a rayon brush subjected to conducting treatment (pile length: 5.0 mm, fiber density: 56,000 F/25 mm$^2$, resistivity: $1.2\times10^8$ $\Omega\cdot$cm), and it was installed so that brush length pressed onto the photosensitive member would be 1.0 mm. The contact electrifier generated an alternating current electric field of 500 Hz (applied voltage: 1.5 kV). The charge erasing light source was installed in such a manner that the light exposure was performed at a location immediately before the contact electrifier, and the light exposure was performed while cutting light of a wavelength of 600 nm or less by the filter 10.

Sensitivity characteristic of the photosensitive member was determined by measuring surface potential by means of a surface potentiometer provided at the location of the image development means to detect the repetition of dark parts and light parts, while the light exposure amount by the laser ray was varied. The results are shown in FIG. 8. In FIG. 8, the initial characteristic is represented by the curve A, and the characteristic after 10,000 times of image formation in this example is represented by the curve B.

Further, dark decay of the photosensitive member after 10,000 times of image formation according to the method of this example was measured by a surface potentiometer. The results are shown in FIG. 9. As in FIG. 8, the initial characteristic is represented by the curve A, and the characteristic after 10,000 times of image formation in this example is represented by the curve B. As clearly seen from the results shown in FIGS. 8 and 9, degradation of the sensitive characteristic and dark decay was slight as in Example 1, and images were obtained with quality equivalent to the initial quality.

According to the image-forming apparatus and the image-forming method of the present invention, effective and uniform charge erasing can be realized in electrophotographic image formation utilizing a high-gamma photosensitive member. Accordingly, they can prevent so-called hysteresis and sensitivity shift even in continuous image formation, and can provide stable image formation with high quality and high resolution without residual images.

What is claimed is:

1. An image-forming apparatus comprising a photosensitive member having a gamma for latent image of 3 or more, electrification means, light exposure means, image development means, image transfer means, cleaning means, and a charge erasing light source, wherein the image-forming apparatus further comprises electric field applying means for applying an alternating current electric field at a frequency of 50 Hz to 1 kHz to a portion of the photosensitive member which is excited through light exposure by the charge erasing light source to uniformly erase any latent image.

2. The image-forming apparatus of claim 1, which comprises, around a rotatably maintained cylindrical photosensitive member 1 having a gamma for latent image of 3 or more, a main electrifier 2, the light exposure means 3, the image development means 4, the image transfer means 5, and the cleaning means 6 in this order, wherein the image-forming apparatus further comprises the charge erasing light source 7 for light exposure of photosensitive member surface and the electric field applying means 9 for applying an alternating current electric field at a frequency of 50 Hz to 1 kHz to a portion of the photosensitive member which is excited through light exposure by the charge erasing light source between the cleaning means 6 and the main electrifier 2.

3. The image-forming apparatus of claim 1 or 2, wherein the apparatus comprises an alternating current electrifier which is the electric field applying means 9 between the charge erasing light source 7 and the photosensitive member surface which is light-exposed by the charge erasing light source, which electrifier applies an alternating current electric field at a frequency of 50 Hz to 1 kHz to a portion of the photosensitive member excited through light exposure by the charge erasing light source.

4. The image-forming apparatus of claim 1 or 2, wherein the apparatus comprises an alternating current electrifier which is the electric field applying means 9 immediately after the charge erasing light source 7 with respect to the photosensitive member surface, which electrifier applies an alternating current electric field at a frequency of 50 Hz to 1 kHz to a portion of the photosensitive member which is excited through light exposure by the charge erasing light source.

5. The image-forming apparatus of claim 1 or 2, wherein the electric field applying means is a contact electrifier 9*a* generating an alternating current electric field at a frequency of 50 Hz to 1 kHz, which is provided immediately after the charge erasing light source 7*a* with respect to the photosensitive member surface so that a portion of the photosensitive member which is excited through light exposure by the charge erasing light source 7*a* is contacted by the contact electrifier 9*a,* and applied with an alternating current electric field at a frequency of 50 Hz to 1 kHz.

6. The image-forming apparatus of claim 5, wherein the charge erasing light source 7 is provided with a filter which cuts light of a wavelength shorter than sensitization wavelength for the photosensitive member used for the light exposure means by 150 nm or more.

7. The image-forming apparatus of claim 5, wherein a direct current electric field is superimposed on the alternating current electric field by using a direct current bias voltage in the range of from −1 kV to +1 kV.

8. The image-forming apparatus of claim 1, wherein the photosensitive member has a gamma for latent image of 6 or more.

9. A method for electrophotographic image formation comprising electrification of a photosensitive member having a gamma for more latent image of 3 or more, light exposure of the member, image development, image transfer, and charge erasing of the photosensitive member, wherein the charge erasing of the photosensitive member is performed by light-exposing a surface portion of the photosensitive member with a charge erasing light source, and applying an alternating current electric field at a frequency of 50 Hz to 1 kHz to the portion of the photosensitive member while the portion is excited by the light exposure to uniformly erase any latent image.

10. The method of claim 9, wherein the photosensitive member has a gamma for latent image of 6 or more.

* * * * *

UNITED STATES PATENT AND TRADEMARK OFFICE

CERTIFICATE OF CORRECTION

PATENT NO. : 6,233,416 B1
DATED : May 15, 2001
INVENTOR(S) : Kinosita et al.

It is certified that error appears in the above-identified patent and that said Letters Patent is hereby corrected as shown below:

Column 3,
Line 35, after "another" insert -- of --.

Column 12,
Line 46, delete "more latent" and insert -- latent --.

Signed and Sealed this

Twenty-fifth Day of June, 2002

*Attest:*

*Attesting Officer*

JAMES E. ROGAN
*Director of the United States Patent and Trademark Office*